US008480509B1

(12) United States Patent
Wright

(10) Patent No.: US 8,480,509 B1
(45) Date of Patent: Jul. 9, 2013

(54) GOLF SWING ENHANCEMENT DEVICE

(76) Inventor: Chris B. Wright, Grove City, OH (US)

( * ) Notice: Subject to any disclaimer, the term of this patent is extended or adjusted under 35 U.S.C. 154(b) by 120 days.

(21) Appl. No.: 13/197,191

(22) Filed: Aug. 3, 2011

(51) Int. Cl.
*A63B 57/00* (2006.01)

(52) U.S. Cl.
USPC ..... 473/299; 473/408

(58) Field of Classification Search
USPC ..... 473/299
See application file for complete search history.

(56) References Cited

U.S. PATENT DOCUMENTS 2,962,288 A 11/1960 Lowden
3,533,630 A 10/1970 Monaco
5,388,824 A * 2/1995 Reimers ..... 473/406
5,984,795 A * 11/1999 Stafford ..... 473/206
6,491,591 B1 12/2002 Schuster
6,656,056 B1 12/2003 Leonard
7,128,656 B1 10/2006 Orchel

* cited by examiner

*Primary Examiner* — Michael Dennis

(57) ABSTRACT

The golf swing enhancement device provides advantages to a golfer in order to improve a golf swing. First and foremost, a proper golf swing is almost impossible without a proper grip. Ideally, the leading thumb is positioned by the device directly atop the handle, but all physical makeups and traits and talents of individuals differ, so the handle device is adjustably fitted to a club handle. Due to the flexibility of the handle device, it can be positioned as chosen on the handle, including the option of rotating the handle device from directly atop the handle to a more effective position of the clock, depending upon the golfer. Additionally, the handle device may be used to overcompensate a position, for example, and thereby employed as a learning or a swing adjustment device.

1 Claim, 3 Drawing Sheets

GOLF SWING ENHANCEMENT DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

There exist any number of ways to improve a golf swing, and probably dozens of tools and gadgets for each way. However, nothing can occur correctly prior to correctly gripping a golf club. The grip of a golf club handle is the very basis of a good golf swing. The present device provides for teaching a golfer, and especially a beginning golfer, proper grip of a golf club handle, and further provides for adjusting that grip for maximum benefit in a golf swing.

FIELD OF THE INVENTION

The golf swing enhancement device relates to golf swing enhancement devices and more especially to a grip enhancement device that provides for a golfer to correctly grip a club handle, and to adjust that grip as necessary in order to enhance a golf swing.

SUMMARY OF THE INVENTION

The general purpose of the golf swing enhancement device, described subsequently in greater detail, is to provide a golf swing enhancement device which has many novel features that result in an improved golf swing enhancement device which is not anticipated, rendered obvious, suggested, or even implied by prior art, either alone or in combination thereof.

To attain this, the golf swing enhancement device provides advantages to a golfer in order to improve a golf swing. First and foremost, a proper golf swing is almost impossible without a proper grip. It is universally understood and taught that a proper grip is one in which the one thumb leads downwardly on the club handle of a golf club. Ideally, the leading thumb is directly atop the handle, but all physical makeups and traits and talents of individuals differ, so the handle device is adjustably fitted to a club handle. Due to the flexibility of the handle device, it can be positioned as chosen on the handle, including the option of rotating the handle device from directly atop the handle to a more effective position of the clock, depending upon the golfer. Experimentation can easily establish a most effective position. Additionally, the handle device may be used to overcompensate a position, for example, and thereby employed as a learning or a swing adjustment device. Further, the handle device may be comprised of an elasticized material that does not employ a set screw or a split. The scallops may be included in the handle device tube for best handle fit while providing for best handle grip. The flat end at the second end of the handle device may be included in order to negate any upward peeling of an otherwise tapering second end. The slightly bulbous nature atop the flexible tube may be included to best fit the natural grip of a user. The slightly flexible concave base ensures a positive, gap free fit to a club handle. The divot device is not only useful to every golfer, but importantly handy in tightening and loosening the set screw of the flexible tube.

Thus has been broadly outlined the more important features of the improved golf swing enhancement device so that the detailed description thereof that follows may be better understood and in order that the present contribution to the art may be better appreciated.

An object of the golf swing enhancement device is to teach proper golf club handle grip.

Another object of the golf swing enhancement device is to enhance a golfer's swing through proper club handle grip.

A further object of the golf swing enhancement device is to provide for grip adjustment.

An added object of the golf swing enhancement device is to be easily fitted to a golf club handle.

And, an object of the golf swing enhancement device is to be easily removed from a golf club handle.

These together with additional objects, features and advantages of the improved golf swing enhancement device will be readily apparent to those of ordinary skill in the art upon reading the following detailed description of presently preferred, but nonetheless illustrative, embodiments of the improved golf swing enhancement device when taken in conjunction with the accompanying drawings.

DETAILED DESCRIPTION OF THE DRAWINGS

With reference now to the drawings, and in particular FIGS. 1 through 5 thereof, the principles and concepts of the golf swing enhancement device generally designated by the reference number 10 will be described.

Figure 2:
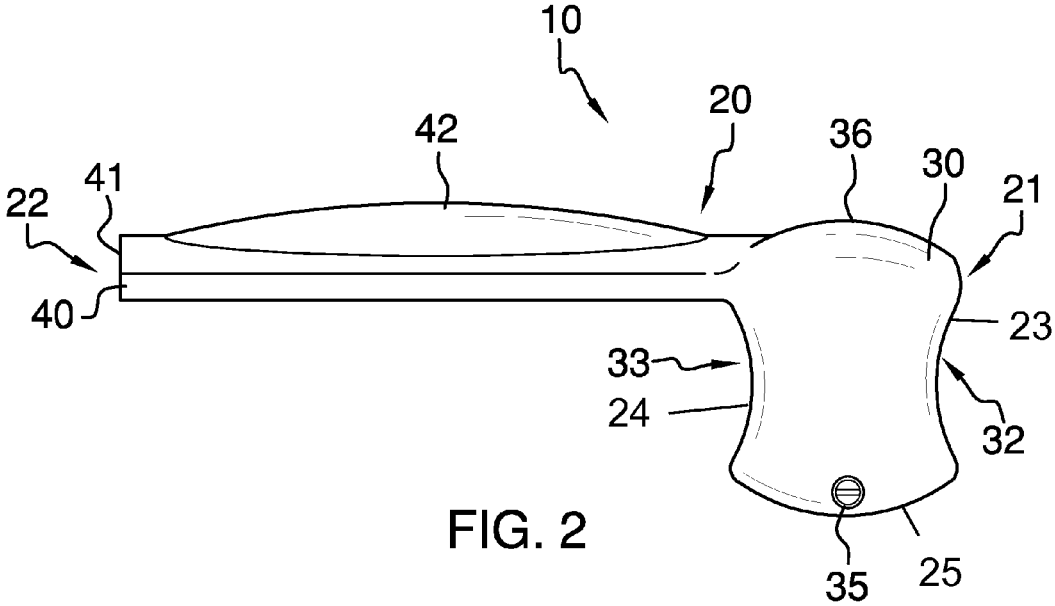
FIG. 2 is a lateral elevation view of the handle device.

Referring to FIG. 2, the golf swing enhancement device 10 partially comprises the handle device 20 having a first end 21 spaced apart from a second end 22.

Figure 1:
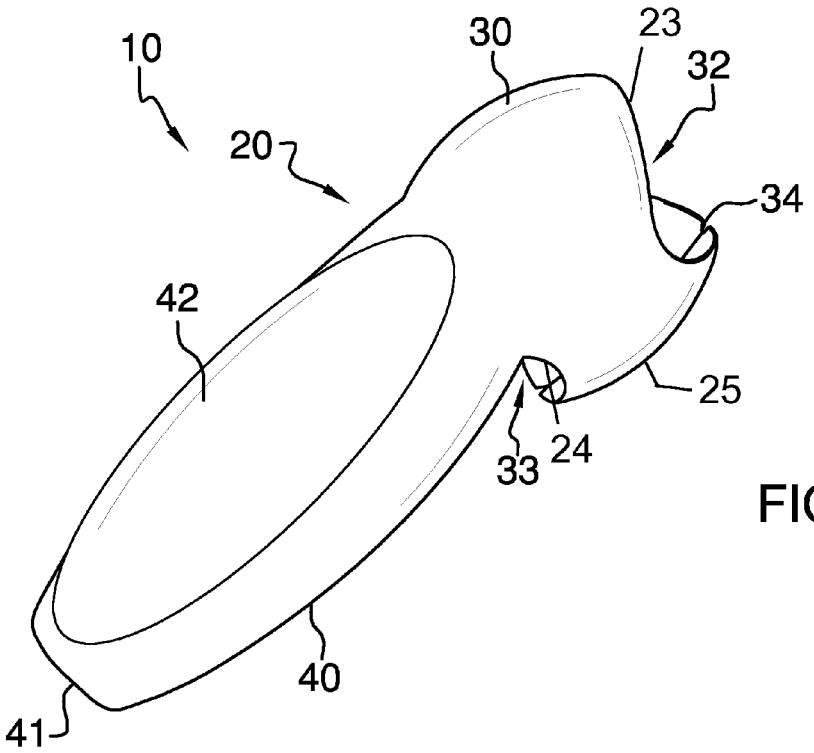
FIG. 1 is a perspective view of the handle device.

Referring to FIGS. 1 and 2, a flexible hollow tube 30 is disposed at the first end 21. The tube 30 has a forward end 23, a rearward end 24 and a convex bottom end 25. The tube 30 has a convex first scallop 32 disposed on the forward end 23 opposite a convex second scallop 33 disposed on the rearward end 24 proximal the bottom end 25. The bulbous projection 36 is continuously disposed atop the tube 30 in a position between the forward end 23 of the tube 30 and a base 40 to best fit a user's grip.

Figure 3:
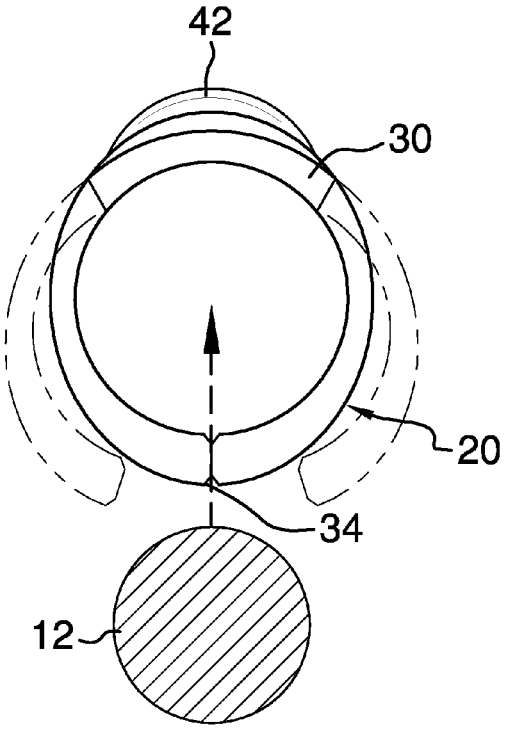
FIG. 3 is a first end view of the handle device.

Referring to FIG. 3, a split 34 in the tube 30 is continuously disposed on the bottom end 25 between the first scallop 32 and the second scallop 33 along a longitudinal mid-line axis of the bottom end 25.

Figure 4:
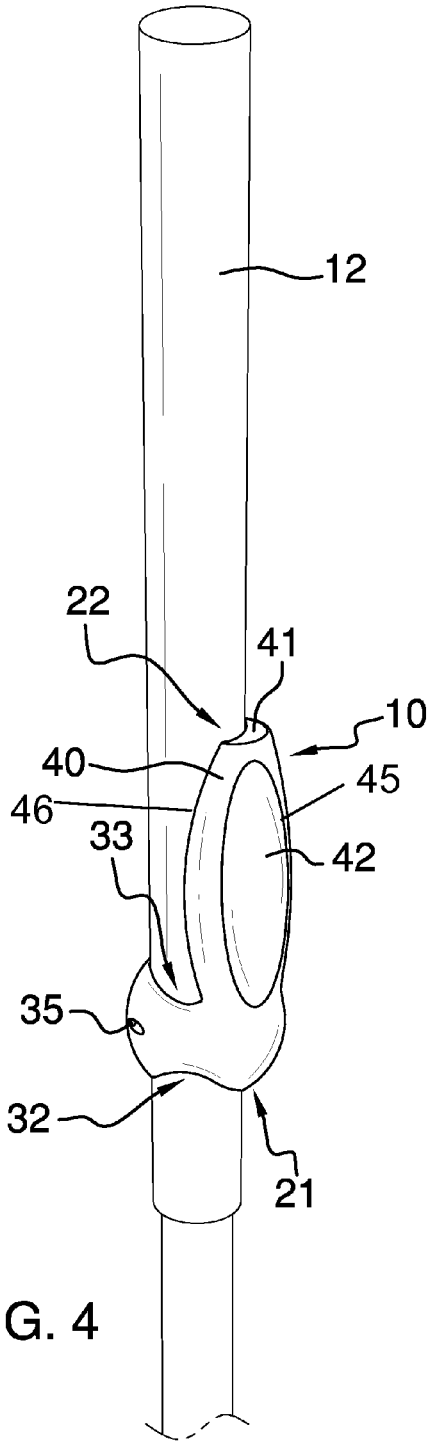
FIG. 4 is a perspective view of the handle device installed on a club handle.

Referring to FIG. 4, the set screw 35 selectively closes the split 34 to secure the device 10 around an existing club shaft 12.

Referring again to FIGS. 3 and 4, a base 40 is extended from the flexible tube 30 proximal the rearward end 24 to the second end 22. The base 40 has a convex front side 45, a concave rear side 46, and an oval shape. The rear side 46 is configured to conform to an existing club shaft 12. A flat shelf 41 is disposed on the base 40, extending from the front side to the rear side at the second end 22. The flat shelf 41 importantly prevents the second end 22 from curling up or fraying, traits that might be manifested with an end that tapered to a thin extension at the second end 22.

Referring again to FIG. 1, a convex thumb pad 42 is centrally disposed on the front side of the base 40. The thumb pad 42 has an oval shape to conform to the shape of a volar pad of a golfer's thumb. The thumb pad 42 guides a user in thumb placement, a key to the golfer's correct grip of the existing club shaft 12 which, in turn, assists in performing a correct golf swing.

Figure 5:
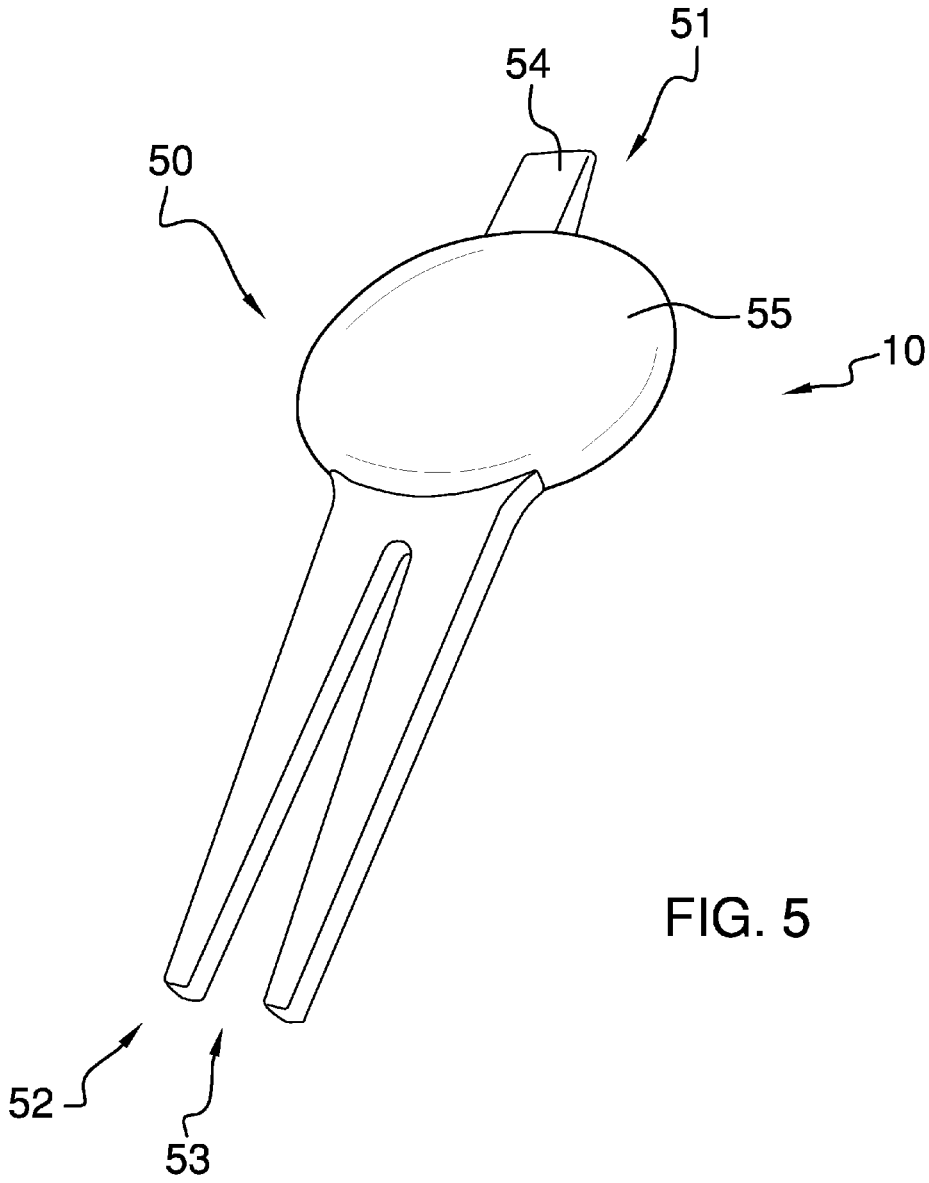
FIG. 5 is a perspective view of the divot device.

Referring to FIG. 5, a divot device 50 has a first device end 51 spaced apart from a second device end 52. The pair of prongs 53 is extended to the second device end 52. A screwdriver 54 is disposed at the first device end 51. The screwdriver 54 is selectively fitted to the set screw 35 in tightening the handle device 20 to removably secure the handle device 20 to the existing club shaft 12. The device grip 55 is attached to divot device 50 in a position diametrically opposed to the prongs 53.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the golf swing enhancement device may be used.

What is claimed is:

1. A golf swing enhancement device comprising, in combination: a handle device having a first end spaced apart from a second end; a flexible hollow tube disposed at the first end, wherein the tube has a forward end, a rearward end, and a convex bottom end; a split in the tube disposed on the bottom end between a first scallop and a second scallop along a longitudinal mid-line axis of the bottom end; a set screw, wherein the set screw is configured to selectively secure the split in a closed position around an existing club shaft; a base extended from the elasticized tube to the second end, the base having a convex front side and a concave rear side; a bulbous projection continuously disposed atop the flexible tube in a position between the forward end of the tube and the base; a flat shelf disposed on the base at the second end, the shelf extending from the front side to the rear side of the base; a convex thumb pad disposed on the front side of the base, the thumb pad having an oval shape; wherein the tube and the base rear side are configured to conform to an existing club shaft; a divot device having a first device end spaced apart from a second device end; a pair of prongs extended to the second device end; a screwdriver disposed at the first device end, the screwdriver selectively fitted to the set screw; and a device grip attached to divot device in a position diametrically opposed to the prongs.

* * * * *